US011532865B2

(12) United States Patent
Dejardin et al.

(10) Patent No.: US 11,532,865 B2
(45) Date of Patent: Dec. 20, 2022

(54) PCB ANTENNA, ELECTRONIC CIRCUIT AND ITEM OF ELECTRONIC EQUIPMENT PROVIDED WITH SUCH AN ANTENNA

(71) Applicant: SAGEMCOM BROADBAND SAS, Rueil-Malmaison (FR)

(72) Inventors: Romain Dejardin, Rueil Malmaison (FR); Serge Contal, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 16/770,752

(22) PCT Filed: Dec. 6, 2018

(86) PCT No.: PCT/EP2018/083850
§ 371 (c)(1),
(2) Date: Jun. 8, 2020

(87) PCT Pub. No.: WO2019/121045
PCT Pub. Date: Jun. 27, 2019

(65) Prior Publication Data

US 2021/0143521 A1 May 13, 2021

(30) Foreign Application Priority Data

Dec. 18, 2017 (FR) ..... 1762396

(51) Int. Cl.
*H01Q 1/42* (2006.01)
*H01Q 9/42* (2006.01)
*H01Q 1/12* (2006.01)

(52) U.S. Cl.
CPC ..... *H01Q 1/12* (2013.01); *H01Q 1/42* (2013.01); *H01Q 9/42* (2013.01)

(58) Field of Classification Search
CPC ..... H01Q 1/38; H01Q 9/42
See application file for complete search history.

(56) References Cited

U.S. PATENT DOCUMENTS

| | | | | |
|---|---|---|---|---|
| 7,289,069 | B2 * | 10/2007 | Ranta | H01Q 9/30 343/702 |
| 7,322,833 | B1 * | 1/2008 | Hakansson | H05K 3/365 439/67 |
| 7,656,354 | B2 * | 2/2010 | Park | H01Q 1/243 343/702 |
| 9,337,532 | B2 * | 5/2016 | Vanjani | H01Q 1/38 |
| 10,775,490 | B2 * | 9/2020 | Baheti | H01Q 1/38 |
| 2008/0316116 | A1 * | 12/2008 | Hobson | H01Q 1/243 343/702 |

(Continued)

*Primary Examiner* — Jason Crawford
(74) *Attorney, Agent, or Firm* — Muncy, Geissler, Olds & Lowe, P.C.

(57) ABSTRACT

Antenna comprising a fastening body bearing an electrically conductive circuit having at least one signal input segment and one radiating segment, the fastening body comprising two positioning portions defining therebetween a passage dimensioned to receive one edge of a PCB carrier, the input segment being borne by one of the positioning portions in order to extend facing one face of said carrier and the body comprising means for clamping the carrier against one of the positioning portions. Electronic circuit and item of electronic equipment comprising such an antenna.

12 Claims, 2 Drawing Sheets

(56) References Cited

U.S. PATENT DOCUMENTS

| | | | | |
|---|---|---|---|---|
| 2008/0316117 | A1* | 12/2008 | Hill | H01Q 13/10 343/702 |
| 2009/0173795 | A1* | 7/2009 | Ochi | H01Q 7/06 257/679 |
| 2009/0278751 | A1 | 11/2009 | Nebashi | |
| 2010/0164811 | A1 | 7/2010 | Cheng et al. | |
| 2013/0112754 | A1* | 5/2013 | Ikemoto | G06K 7/10336 235/488 |
| 2014/0159990 | A1* | 6/2014 | Azhari | H05K 3/303 29/601 |
| 2015/0138030 | A1* | 5/2015 | Yosui | H01Q 1/38 343/895 |
| 2016/0372819 | A1* | 12/2016 | Okamoto | H05K 1/14 |
| 2019/0089046 | A1* | 3/2019 | Koshi | H01Q 1/2291 |
| 2021/0143521 | A1* | 5/2021 | Dejardin | H01Q 1/38 |

* cited by examiner

PCB ANTENNA, ELECTRONIC CIRCUIT AND ITEM OF ELECTRONIC EQUIPMENT PROVIDED WITH SUCH AN ANTENNA

The present invention relates to the field of radio frequency (RF) transmission.

STATE OF THE ART

Electronic circuits are known that comprise a support plate carrying electronic components connected to electrically conductive tracks printed on the support plate.

When the electronic circuit is dedicated to radiofrequency transmission of signals, one of the tracks is connected to an antenna.

The antenna may be of various forms. There exist antennas that are formed directly by conductive tracks extending on the support plate. Nevertheless, that increases the size of the support plate. There also exist separate antennas that are connected to the conductive tracks of the support plate via a connector and electronic cables. That complicates fabrication of the electronic circuit and makes it necessary to provide means for fastening the antenna in a housing containing the electronic circuit.

OBJECT OF THE INVENTION

An object of the invention is to provide means for simplifying the fabrication of electronic circuits having an antenna, but without increasing the size thereof.

BRIEF SUMMARY OF THE INVENTION

To this end, the invention provides an antenna comprising a fastener body carrying an electrically conductive circuit having at least one signal input segment and a radiating segment, the fastener body comprising two positioning portions defining between them a passage of dimensions suitable for receiving an edge of a printed circuit support plate, the input segment being carried by one of the positioning portions to extend facing a face of said support plate, and the body including clamping means for clamping the support plate against at least one of the positioning portions.

Thus, the antenna is arranged to be fastened on an edge of the printed circuit plate, thereby limiting the footprint of the antenna on the printed circuit plate and enabling the connection with the printed circuit to be provided in simple manner by means of an input segment that extends facing one of the faces of said plate.

Advantageously, the clamping means comprise an elastically deformable region connecting at least one of the positioning portions to the remainder of the body in order to urge said positioning portion into a position in which the passage has a width that is less that the thickness of the support plate.

This fastening technique is particularly simple, since the clamping force is merely the result of the elasticity of the fastener body without requiring any recourse to external clamping means.

In a first embodiment, the input segment is positioned to establish electromagnetic coupling with an electrically conductive track of the support plate.

This connection technique is simple to fabricate and quite robust.

In a second embodiment, the antenna circuit has two contacts, each mounted in one of the positioning portions to have one end projecting resiliently from said positioning portion and facing the other positioning portion in order to form two input segments.

Advantageously, the radiating portion is in relief.

This improves the transmission and reception performance of the antenna.

The invention also provides an electronic circuit comprising:

- a support plate carrying electronic components connected to electrically conductive tracks extending over a at least one first face of the support plate,
- an antenna comprising a fastener body carrying an electrically conductive circuit having at least one signal input segment and a radiating segment, the fastener body comprising two positioning portions defining between them a passage in which an edge of the support plate is clamped, the input segment being carried by one of the positioning portions so as to extend facing a face of said support plate.

Finally, the invention provides electronic equipment comprising a housing receiving such an electronic circuit, with the antenna also extending inside the housing in the vicinity of an outside wall thereof so as to have a radiation field beyond this outside wall of the housing.

Other characteristics and advantages of the invention appear on reading the following description of particular, nonlimiting embodiments of the invention.

BRIEF DESCRIPTION OF THE FIGURES

Reference is made to the accompanying drawings, in which.

DETAILED DESCRIPTION OF THE INVENTION

Figure 1:
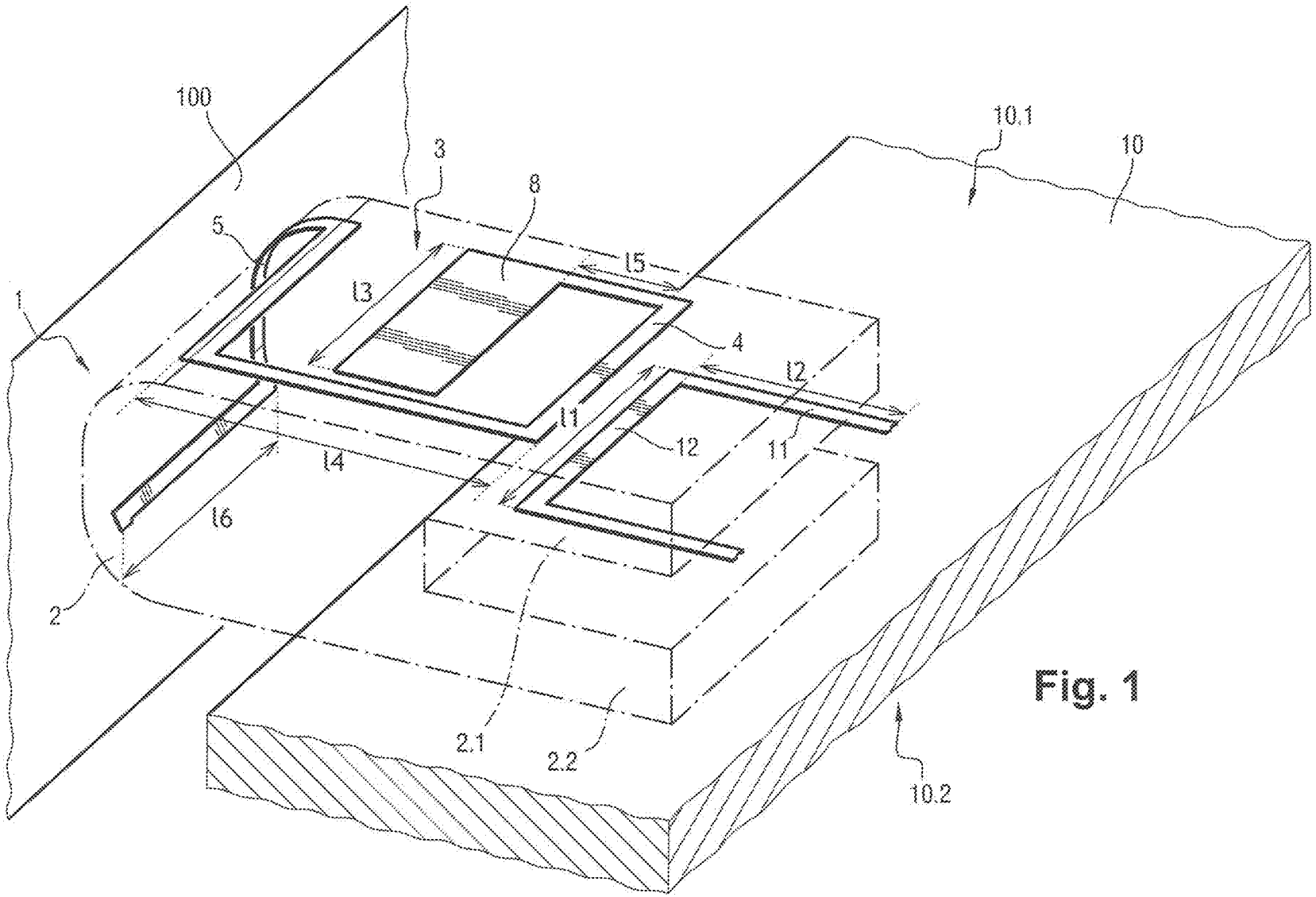
FIG. 1 is a fragmentary diagrammatic view in perspective of electronic equipment in a first embodiment of the invention.

With reference to the figures, the invention is described herein in its application to electronic equipment including a housing that encloses an electronic circuit.

The electronic circuit comprises:

- a support plate 10 (also known as a printed circuit board (PCB)) having a first face 10.1 and a second face 10.2,
- electrically conductive tracks 11 extending on the first face 10.1 and on the second face 10.2 of the support plate 10 in order to form a printed circuit,
- electronic components carried by the support plate 10 and electrically connected to the conductive tracks 11,
- an antenna given overall reference 1.

The antenna 1 comprises a fastener body 2 made of an electrically insulating material and carrying an electrically conductive circuit given overall reference 3. The fastener body 2 has two positioning portions 2.1 and 2.2 defining between them a passage that is defined by parallel flanks that are spaced apart by a distance that is sufficient to receive an edge of the support plate 10. In this example, the fastener body 2 has a thickness of 5.25 millimeters (mm) and it is made of acrylonitrile-butadiene-styrene (ABS) with permittivity $\varepsilon r$ of about 2.8.

The fastener body 2 has clamping means for clamping the support plate 10 against at least one of the positioning portions 2.1, 2.2. The clamping means comprise an elastically deformable region connecting the positioning portions 2.1 and 2.2 to the remainder of the body in order to urge said positioning portions into a position in which the width of the passage is less than the thickness of the support plate 10 so that the edge of the support plate 10 is clamped in the passage by the positioning portions 2.1 and 2.2 pinching elastically onto the edge of the support plate 10.

The circuit 3 comprises at least one signal input segment and a radiating segment 5. The radiating segment 5 is in relief, i.e. it extends over a surface that is not plane, and more precisely in this example that is curved about a single axis.

The input segment is carried by the positioning portion 2.1 so as to extend facing the face 10.1 of the support plate 10.

The circuit 3 is arranged to be a single-band circuit or a multiband circuit. By way of example, the circuit 3 operates at a frequency of 2.45 gigahertz (GHz) for use in the 2.4 GHz to 2.5 GHz frequency band that is used in local wireless networks complying with the IEEE 802.11 standard.

Preferably, the circuit 3 has an impedance of 50 ohms, and is arranged to present a return loss of more than 10 decibels (dB) and efficiency of at least 70%, i.e. 70% of the energy consumed is radiated.

The antenna 1 extends in the housing in the vicinity of an outside wall 100 of the housing in order to have a radiation field beyond this outside wall 100 of the housing.

In an embodiment of FIG. 1, the input segment, given numerical reference 4, is positioned so as to establish electromagnetic coupling with the electrically conductive track 12 of the support plate 10. For this purpose, when the fastener body 2 is correctly positioned on the edge of the support plate 10, the input segment 4 extends parallel to the track 12 and facing it. Preferably, the input segment 4 is spaced apart from the track 12 by a distance lying in the range 1 mm to 5 mm.

The conductive track 12 has a width of 0.5 mm with a main segment of length l1 of 7.50 mm and two end segments, perpendicular to the main segment, each having a length l2 of 3.65 mm. The input segment 4 has the same length and the same width as the main segment of the conductive track 12. The input segment 4 has a first end connected to an artificial ground 8 of length l3 of 6.25 mm by an intermediate segment of length l5 of 2.5 mm and a second end connected to the radiating segment 5 by an intermediate segment of length l4 of 8.05 mm. The radiating segment 5 is substantially U-shaped, having one branch with its free end connected to the intermediate segment of length l4 and another branch that is free. These branches have a length l6 of 8.94 mm. These numerical values are given solely by way of example.

It should be observed that in this example the fastener body 2 is generally U-shaped, with two outside surfaces that are plane connected to each other by a curved surface that is concave. The plane outside surfaces are parallel to the flanks of the passage. The radiating segment 5 extends over a portion of the plane outside surface secured to the positioning portion 2.1 and over the curved outside surface.

Figure 2:
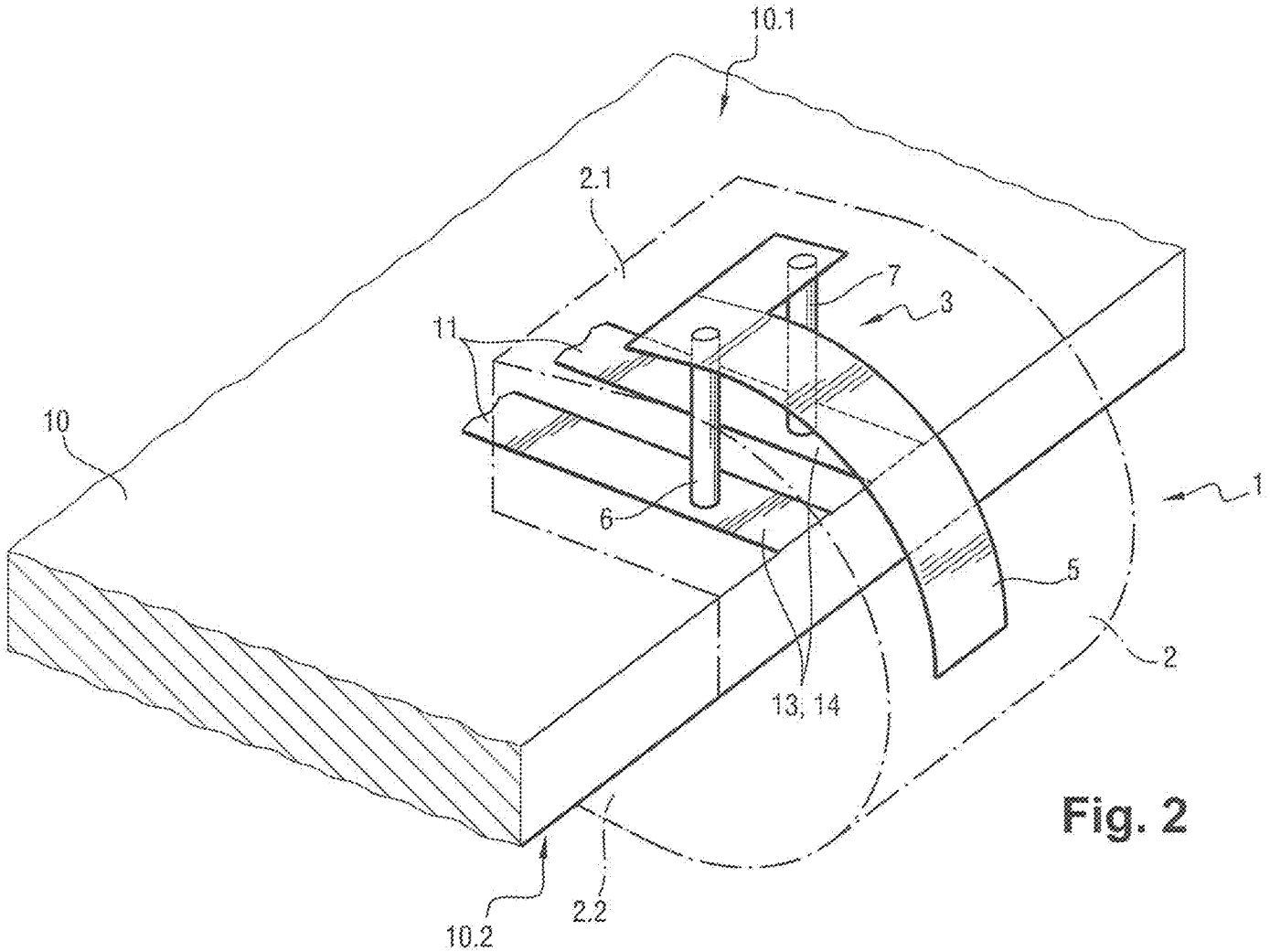
FIG. 2 is a view analogous to FIG. 1 showing electronic equipment in a second embodiment of the invention.

In the embodiment of FIG. 2, the circuit 11 has two electrically conductive areas 13 and 14 extending on the face 10.1 of the support plate 10.

The circuit 3 has two contacts 6 and 7 mounted in the positioning portion 2.1, each having one end projecting resiliently from said positioning portion 2.1 into the passage so as to be pressed resiliently against a respective one of the conductive areas 13 and 14. The contacts 6 and 7 thus form two input segments of the circuit 3.

It should be observed that in this example, the fastener body 2 is generally U-shaped with a cylindrical outside surface of circular section. The radiating segment 5 extends over said outside surface.

Naturally, the invention is not limited to the embodiments described and covers any variant coming within the ambit of the invention as defined by the claims.

In particular, the fastener body may be obtained as a one-piece molding or by assembling together a plurality of pieces.

The fastener body may be of a shape other than that described, and for example it may be in the shape of a parallelepiped.

The clamping means may comprise an element that is screwed into one of the positioning portions of the fastener body so as to press the support plate against the other positioning portion.

The circuit of the antenna may be deposited on the fastener body and then optionally covered in varnish, or it may be embedded in the material of the fastener body.

The body may be made of a plastics material, such as ABS, or of some other material, such as a ceramic.

The electric circuit 3 may be arranged to operate in other frequency band, e.g. in the long term evolution (LTE) or global system for mobiles (GSM) telephone bands.

The invention claimed is:

1. An antenna comprising a fastener body made of electrically insulating material and carrying an electrically conductive circuit having at least one signal input segment and a radiating segment, the fastener body comprising two positioning portions defining between them a passage of dimensions suitable for receiving an edge of a printed circuit support plate, the input segment being carried by one of the positioning portions to extend facing a face of said support plate, and the body including clamping means for clamping the support plate against at least one of the positioning portions.

2. The antenna according to claim 1, wherein the clamping means comprise an elastically deformable region connecting at least one of the positioning portions to the remainder of the fastener body in order to urge said positioning portion into a position in which the passage has a width that is less that the thickness of the support plate.

3. The antenna according to claim 1, wherein the input segment is positioned to establish an electromagnetic coupling with an electrically conductive track of the support plate.

4. The antenna according to claim 1, having two contacts mounted in one of the positioning portions to have one end projecting resiliently from said positioning portion and facing the other positioning portion in order to form two input segments.

5. The antenna according to claim 1, wherein the radiating portion is in relief.

6. The antenna according to claim 5, wherein the radiating portion is curved.

7. An electronic circuit comprising:

a support plate carrying electronic components connected to electrically conductive tracks extending over a at least one first face of the support plate, an antenna comprising a fastener body carrying an electrically conductive circuit having at least one signal input segment and a radiating segment, the fastener body comprising two positioning portions defining between them a passage in which an edge of the support plate, the body including clamping means for clamping the support plate against at least one of the positioning portions and the input segment being carried by one of the positioning portions so as to extend facing one of the faces of said support plate.

8. The electronic circuit according to claim 7, wherein the positioning portions pinch the edge of the support plate resiliently.

9. The electronic circuit according to claim 7, wherein the input segment is positioned to establish electromagnetic coupling with an electrically conductive track of the support plate.

10. The electronic circuit according to claim 7, comprising two electrically conductive areas extending on the support plate and two contacts mounted in one of the positioning portions so that each has one end projecting resiliently from said positioning portion to be applied against a respective one of the conductive areas and to form two input segments.

11. Electronic equipment comprising a housing receiving an electronic circuit according to claim 7, the antenna also extending in the housing in the vicinity of an outside wall thereof in order to have a radiation field beyond this outside wall of the housing.

12. The electronic circuit according to claim 7, wherein the clamping means comprise an elastically deformable region connecting at least one of the positioning portions to the remainder of the fastener body in order to urge said positioning portion into a position in which the passage has a width that is less that the thickness of the support plate.

* * * * *